US006181192B1

(12) United States Patent
Tohyama et al.

(10) Patent No.: US 6,181,192 B1
(45) Date of Patent: Jan. 30, 2001

(54) CONSTANT VOLTAGE CIRCUIT COMPRISING TEMPERATURE DEPENDENT ELEMENTS AND A DIFFERENTIAL AMPLIFIER

(75) Inventors: Ryuji Tohyama; Naruki Suetake; Minoru Abe, all of Tokyo (JP)

(73) Assignee: Mitsubishi Denki Kaibushiki Kaisha, Tokyo (JP)

( * ) Notice: Under 35 U.S.C. 154(b), the term of this patent shall be extended for 0 days.

(21) Appl. No.: 09/441,666

(22) Filed: Nov. 17, 1999

(30) Foreign Application Priority Data

May 14, 1999 (JP) ..... 11-135047

(51) Int. Cl.[7] ..... G05F 1/10
(52) U.S. Cl. ..... 327/513; 327/83; 327/540
(58) Field of Search ..... 327/83, 513, 512, 327/538, 539, 540; 323/312, 313

(56) References Cited

U.S. PATENT DOCUMENTS 4,317,054 * 2/1982 Caruso et al. ..... 327/539
6,091,285 * 7/2000 Fujiwara ..... 327/539

OTHER PUBLICATIONS

Correspondence course, "Lecture for Training Specialist in Analogue Circuit Engineering", 2nd separate volume, Applied Circuit of Operational Amplifier (p. 9, Fig. 1.7), issued by Engineering Research Institute.

* cited by examiner

*Primary Examiner*—Jung Ho Kim
(74) *Attorney, Agent, or Firm*—Sughrue, Mion, Zinn, Macpeak & Seas, PLLC

(57) ABSTRACT

A constant voltage circuit having excellent temperature characteristics at a wide temperature range. Temperature characteristics control means constructed by connecting a voltage dividing circuit formed by connecting fixed resistors in series to a diode in parallel is provided between a fixed resistor and a Zener diode having a positive temperature coefficient of a bridge circuit, and the output of a connection point between the fixed resistors of the temperature characteristics control means is applied to the non-inversion input terminal of a differential amplifier to correct the temperature change of the Zener diode.

7 Claims, 5 Drawing Sheets

FIG. 2

O: $Vd + \Delta Vd$

Δ: $(Vd + \Delta Vd) \times \left(\frac{R22}{R21 + R22} = \alpha_1\right)$

□: $(Vd + \Delta Vd) \times \left(\frac{R22}{R21 + R22} = \alpha_2\right)$

X: $(Vd + \Delta Vd) \times \left(\frac{R22}{R21 + R22} = \alpha_3\right)$

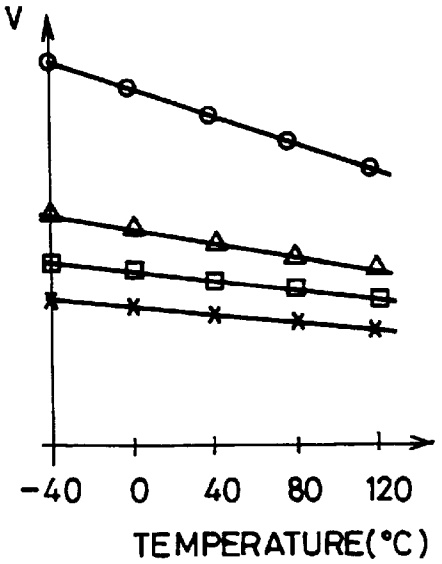

FIG. 3

O: $Vz + \Delta Vz$

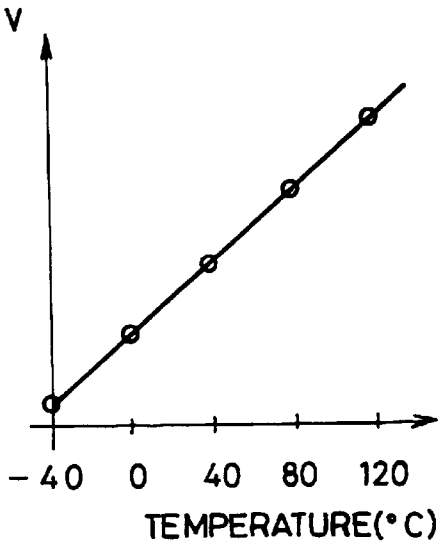

FIG. 4

O: $(Vz + \Delta Vz) + (Vd + \Delta Vd)$

Δ: $(Vz + \Delta Vz) + (Vd + \Delta Vd) \times \alpha_1$

□: $(Vz + \Delta Vz) + (Vd + \Delta Vd) \times \alpha_2$

X: $(Vz + \Delta Vz) + (Vd + \Delta Vd) \times \alpha_3$

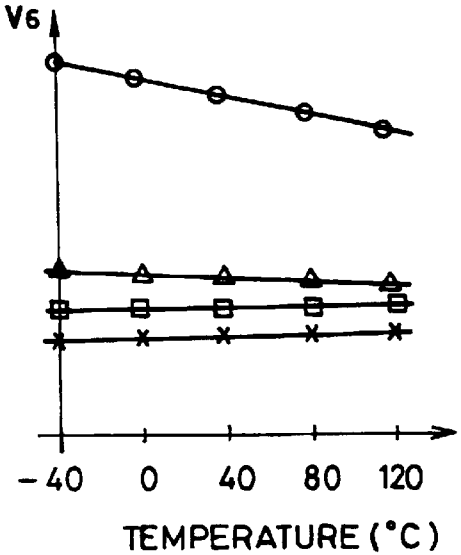

(4-3)

CONSTANT VOLTAGE CIRCUIT COMPRISING TEMPERATURE DEPENDENT ELEMENTS AND A DIFFERENTIAL AMPLIFIER

BACKGROUND OF THE INVENTION

1. Field of the Invention

The present invention relates to a constant voltage circuit used at a wide temperature range, such as a constant voltage circuit used in a car control circuit or the like.

2. Description of the Prior Art

FIG. 5 is a circuit diagram of a prior art constant voltage circuit for stabilizing a voltage from a DC power source. In FIG. 5, reference numeral 100 denotes a differential amplifier, 101, 102 and 103 fixed resistors having resistance values R11, R12 and R13, respectively, and 104 a Zener diode which is a temperature-dependent semiconductor element. In this constant voltage circuit, a series circuit formed on one side by connecting the fixed resistors 101 and 102 in series and a series circuit formed on the other side by connecting the fixed resistor 103 and the Zener diode 104 in series on the other side constitute a bridge circuit, a connection point between the fixed resistor 101 and the fixed resistor 103 of the bridge circuit is connected to the output terminal of the differential amplifier 100, and a connection point between the fixed resistor 102 and the Zener diode 104 is connected to the ground. Further, the output of the connection point of the series circuit on one side is applied to the inversion input terminal of the differential amplifier 100 and the output of the connection point of the series circuit on the other side is applied to the non-inversion input terminal of the differential amplifier 100 so as to output a constant voltage from the output terminal of the differential amplifier 100.

A description is subsequently given of the operation of the above constant voltage circuit.

The voltage V+ of the non-inversion input terminal of the differential amplifier 100 is equal to the voltage Vz at both ends of the Zener diode 104. Therefore, the voltage V_ of the inversion input terminal of the differential amplifier 100 becomes equal to V+ and Vz. Consequently, the output voltage V6 of the differential amplifier 100 is represented by the following equation (1).

$$V6=\{(R11+R12)/R12\}\cdot Vz \quad (1)$$

The above output voltage V6 is a constant value determined by the resistance values R11 and R12 of the fixed resistors 101 and 102 and the Zener voltage Vz of the Zener diode 104. The output voltage V6 of the differential amplifier 100 is referred to as "constant voltage" hereinafter.

Since the Zener diode 104 is a temperature-dependent element, the voltage Vz at both ends of the Zener diode 104 is changed by temperature. The voltage Vz at both ends of the Zener diode 104 is determined by a current Iz running through the Zener diode 104 and changes ΔVz in the voltage Vz caused by a temperature variations (to be referred to as "temperature characteristics" hereinafter) are determined by the voltage Vz. That is, the temperature characteristics ΔVz of the Zener diode 104 are determined by the current Iz running through the Zener diode 104.

The temperature characteristics of the constant voltage circuit of the prior art will be described hereinunder.

The current Iz running through the Zener diode 104 is expressed by the following equation (2).

$$Iz=(V6-Vz)/R13 \quad (2)$$

When the temperature characteristics ΔVz of the Zener diode 104 which are determined by the current Iz running through the Zener diode 104 at a certain temperature range are taken into consideration, the voltage V_ of the inversion input terminal of the differential amplifier 100 is expressed by the equation V_=Vz+ΔVz. Therefore, the constant voltage V6 is expressed by the following equation (3) when the temperature characteristics ΔVz of the Zener diode 104 are taken into consideration.

$$V6=\{(R11+R12)/R12\}\cdot(Vz+\Delta Vz) \quad (3)$$

The temperature characteristics ΔV6 of the constant voltage V6 are expressed by the following equation (4).

$$\Delta V6=\{(R11+R12)/R12\}\cdot\Delta Vz \quad (4)$$

Therefore, it is understood that the temperature characteristics ΔV6 of the constant voltage V6 are proportional to the temperature characteristics ΔVz of the Zener diode 104.

SUMMARY OF THE INVENTION

Generally speaking, the value of the temperature characteristics ΔVz of the Zener diode 104 becomes the smallest when the Zener voltage is around 5V, positive when the Zener voltage is higher than 5 V and negative when the Zener voltage is lower than 5 V as shown in FIG. 6. Therefore, in the constant voltage circuit of the prior art, a 5.1 V Zener diode is used as the Zener diode 104 in most cases. However, since the temperature characteristics ΔVz of the Zener diode 104 change like a quadratic curve at around 5 V as shown in FIG. 7, ΔVz is small at an ordinary use range (−10 to 80° C.) but the temperature characteristics ΔV6 of the constant voltage V6 become large at both ends of a wide temperature range(−40 to 120° C.), that is, a high temperature side and a low temperature side, when the constant voltage circuit is used in a car control circuit, thereby making it impossible to obtain high-precision constant voltage characteristics.

It is an object of the present invention which has been made to solve the above problem to provide a constant voltage circuit having excellent temperature characteristics at a wide temperature range.

According to a first aspect of the present invention, there is provided a constant voltage circuit comprising a bridge circuit having a series circuit formed on one side by connecting resistors in series and a series circuit formed on the other side by connecting in series a resistor, a temperature-dependent semiconductor element and temperature characteristics control means including a temperature characteristics correcting element having temperature characteristics opposite to those of the temperature-dependent semiconductor element and provided between the resistor and the temperature-dependent semiconductor element, and a differential amplifier, wherein the output of the connection point of the series circuit on one side of the bridge circuit and the output of the control means on the other side are connected to the input terminal of the differential amplifier.

According to a second aspect of the present invention, there is provided a constant voltage circuit, wherein the control means comprises a temperature characteristics correcting element and a voltage dividing circuit having a series circuit connected in parallel to the temperature characteristics correcting element, and the output of the dividing point of the voltage dividing circuit is applied to the differential amplifier.

According to a third aspect of the present invention, there is provided a constant voltage circuit, wherein the temperature-dependent semiconductor element is a Zener diode having a positive temperature coefficient and the temperature characteristics correcting element is a diode.

According to a fourth aspect of the present invention, there is provided a constant voltage circuit, wherein the Zener diode has a Zener voltage of around 5 V.

According to a fifth aspect of the present invention, there is provided a constant voltage circuit, wherein the Zener current of the Zener diode is set to ensure that the temperature change of the Zener voltage becomes smaller than the temperature change of the voltage at both ends of the diode.

According to a sixth aspect of the present invention, there is provided a constant voltage circuit which is used in a car control circuit.

According to a seventh aspect of the present invention, there is provided a constant voltage circuit which is used in a heat sensitive flow sensor.

The above and other objects, features and advantages of the invention will become more apparent from the following description when taken in conjunction with the accompanying drawings.

BRIEF DESCRIPTION OF THE ACCOMPANYING DRAWINGS

FIG. 2 is a diagram showing temperature changes in the voltage at both ends of a diode according to the embodiment of the present invention;

FIG. 3 is a diagram showing temperature changes in Zener voltage;

FIG. 4 is a diagram showing temperature changes in constant voltage according to the embodiment of the present invention;

DETAILED DESCRIPTION OF THE PREFERRED EMBODIMENT

An preferred embodiment of the present invention will be described hereinunder with reference to the accompanying drawings.

Figure 1:
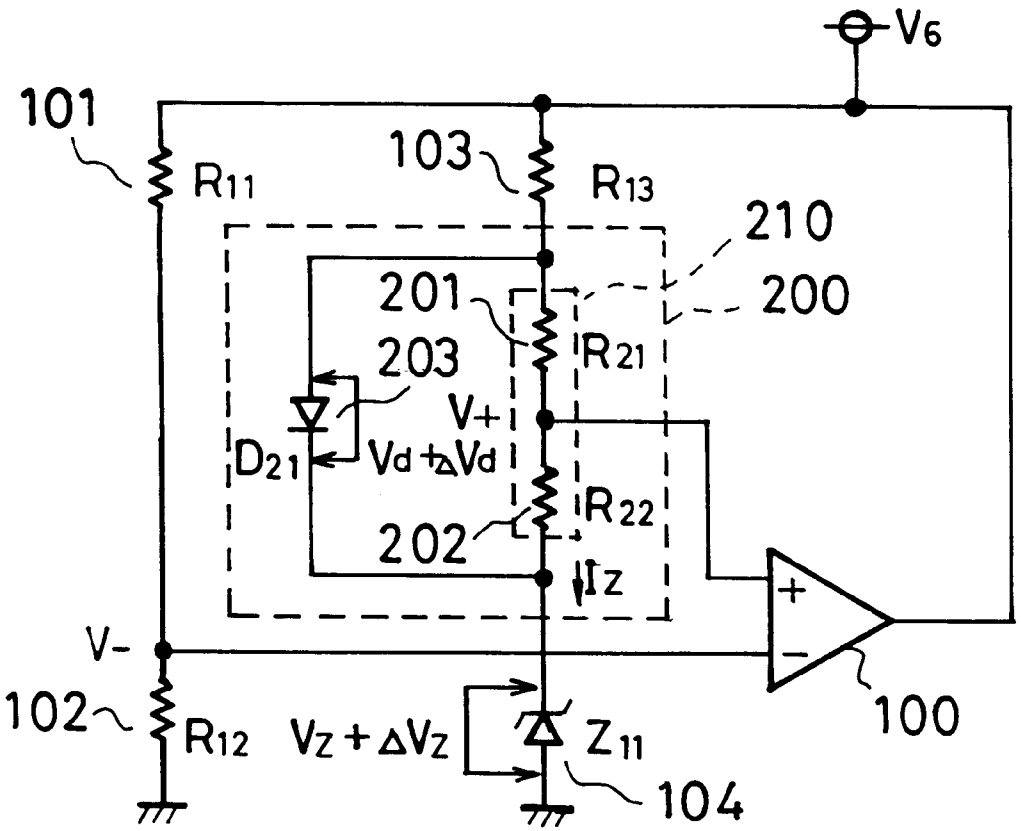
FIG. 1 is a diagram showing the constitution of a constant voltage circuit according to an embodiment of the present invention.
Figure 5:
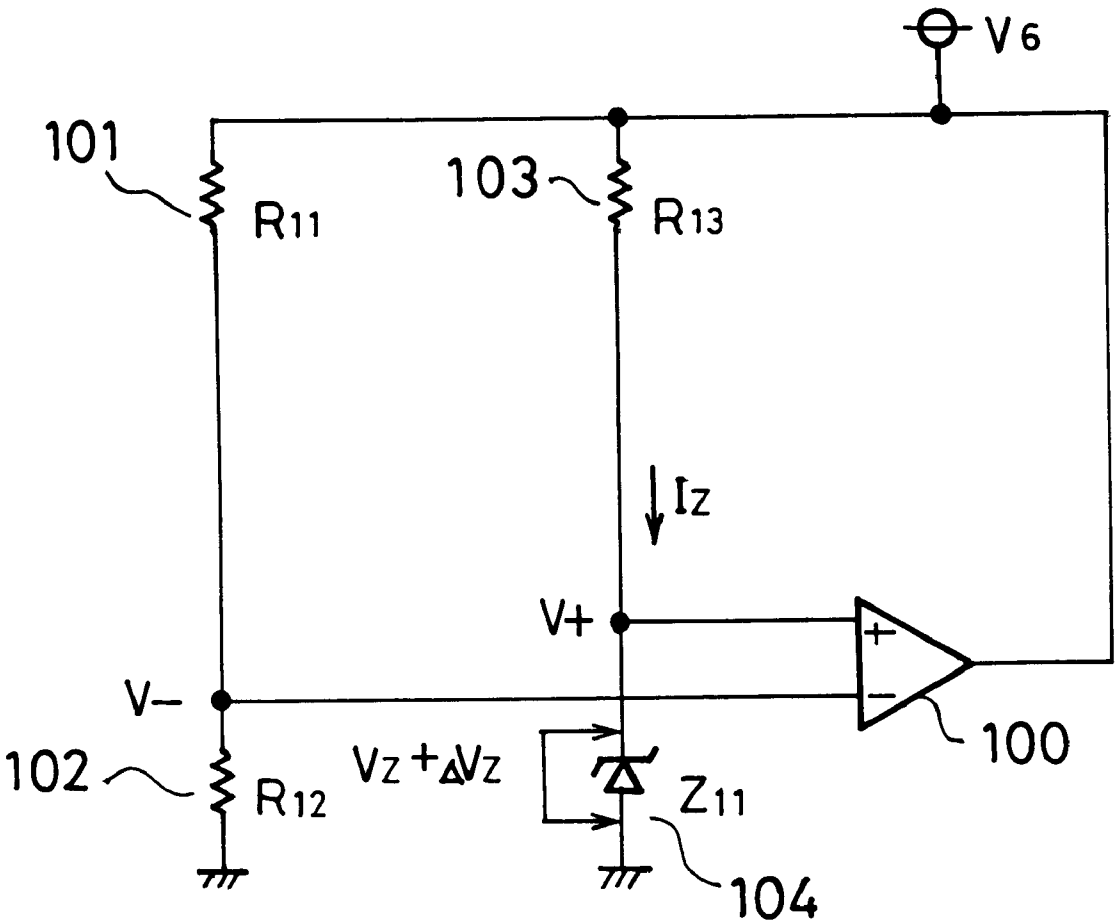
FIG. 5 PRIOR ART
FIG. 5 is a diagram showing the constitution of a constant voltage of the prior art.
Figure 6:
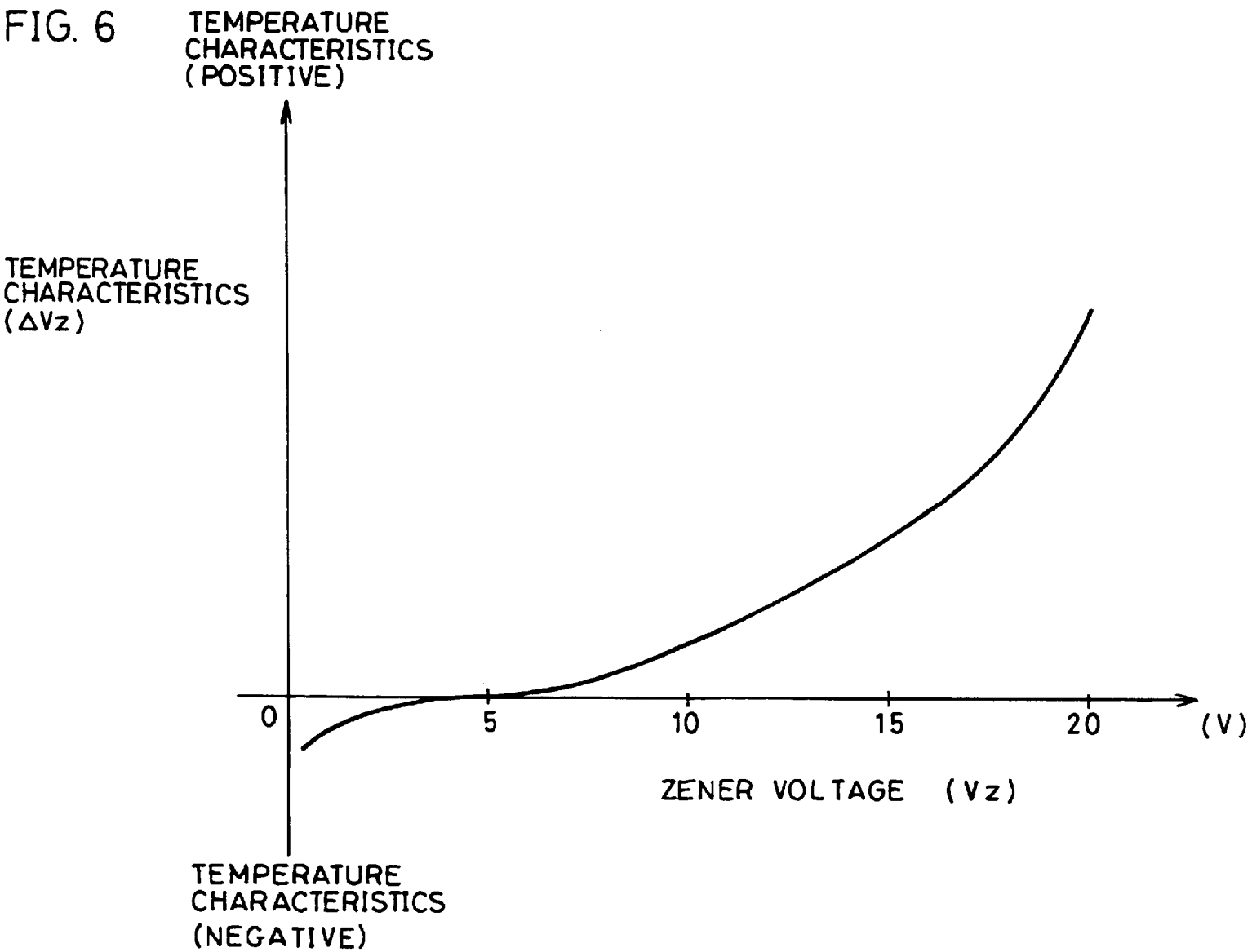
FIG. 6 is a diagram showing the relationship between the Zener voltage and temperature characteristics of a Zener diode.
Figure 7:
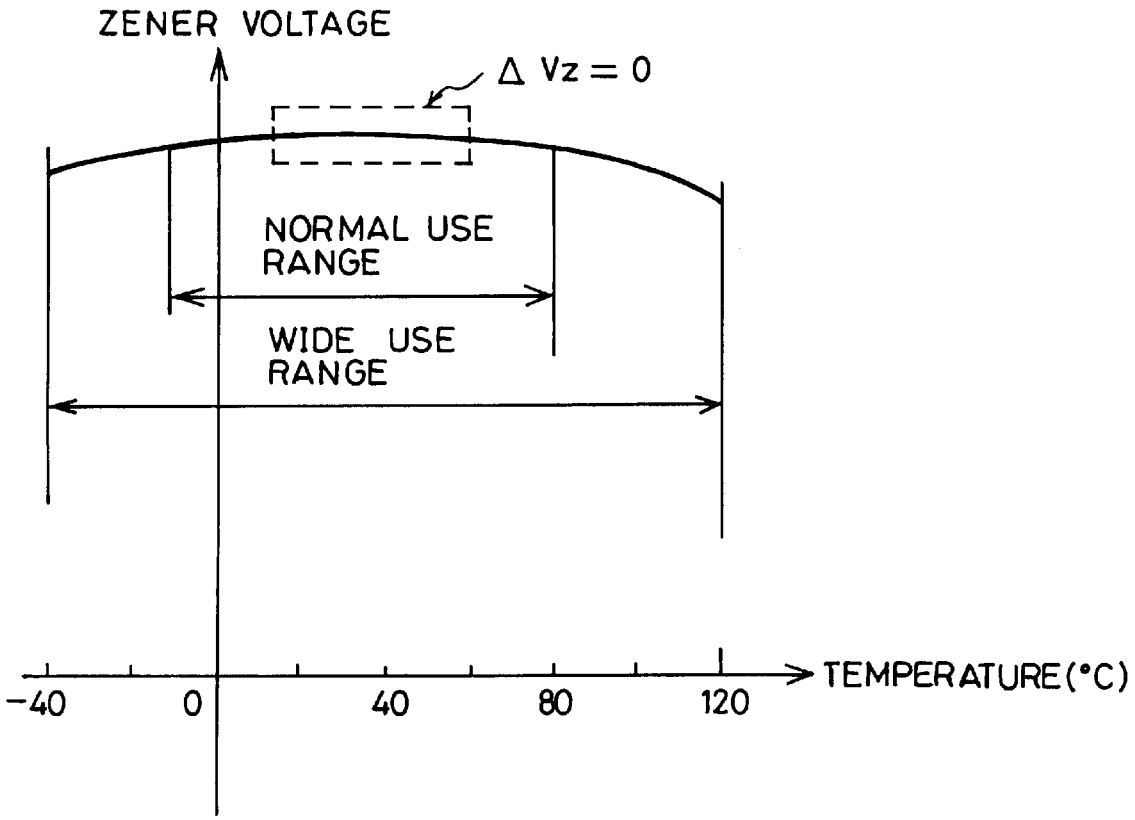
FIG. 7 is a diagram showing temperature changes in Zener voltage.

FIG. 1 is a diagram showing the constitution of a constant voltage circuit according to an embodiment of the present invention. In FIG. 1, reference numeral 100 denotes a differential amplifier, 101, 102, 103, 201 and 202 fixed resistors having resistance values R11, R12, R13, R21 and R22, respectively, 104 a Zener diode which is a temperature-dependent semiconductor element, and 203 a diode which is a temperature characteristics correcting element. A parallel circuit constructed by connecting a voltage dividing circuit 210 formed by connecting the fixed resistor 201 and the fixed resistor 202 in series and the diode 201 in parallel is used as temperature characteristics control means 200.

In the constant voltage circuit of this embodiment, a series circuit formed on one side by connecting the fixed resistor 101 and the fixed resistor 102 in series and a series circuit formed on the other side by connecting the fixed resistor 103, the temperature characteristics control means 200 and the Zener diode 104 in series constitute a bridge circuit, the fixed resistor 101 and the fixed resistor 103 are connected to the output terminal of the differential amplifier 100, and the fixed resistor 102 and the Zener diode 104 are connected to the ground. Further, the output of the connection point of the series circuit on one side is applied to the inversion input terminal of the differential amplifier 100, the output of a connection point (dividing point) between the fixed resistor 201 and the fixed resistor 202 of the voltage dividing circuit 210 constituting the temperature characteristics control means 200 on the other side is applied to the non-inversion input terminal of the differential amplifier 100, and a constant voltage (fixed voltage) V6 is stably output from the output terminal of the differential amplifier 100.

The temperature characteristics of the diode 203 which is a temperature characteristics correcting element will be described hereinunder. Generally speaking, as temperature rises, the forward-direction voltage Vd of a diode falls almost linearly. Therefore, changes ΔVd in the voltage Vd at both ends of the diode 203 caused by temperature variations (temperature characteristics) are generally negative with excellent linearity. Therefore, the diode 203 can be used as a temperature characteristics correcting element for the Zener diode 104 which is a positive temperature-dependent element.

The Zener diode 104 is selected to obtain a Zener voltage having small temperature characteristics with relatively excellent linearity. The temperature characteristics of the Zener diode 104 have already been described in the section of the prior art.

A description is subsequently given of the temperature characteristics of the constant voltage circuit of the present invention.

When the output voltage (constant voltage) of the differential amplifier 100 is represented by V6, the Zener voltage of the Zener diode 104 is represented by Vz and the forward-direction voltage of the diode 203 is represented by Vd, a current Iz running through the Zener diode 104 is expressed by the following equation (5).

$$Iz=(V6-Vz-Vd)/R13 \tag{5}$$

Since the dividing point of the voltage dividing circuit 210 is connected to the non-inversion input terminal of the differential amplifier 100, the voltage V+ of the non-inversion input terminal is expressed by the following equation (6).

$$V+=Vz+\{R22/(R21+R22)\}\cdot Vd \tag{6}$$

Therefore, the voltage V__ of the inversion input terminal of the differential amplifier 100 is expressed by the following equation (7).

$$V__=V+=Vz+\{R22/(R21+R22)\}\cdot Vd \tag{7}$$

When the temperature characteristics ΔVz of the Zener diode 104 and the temperature characteristics ΔVd of the diode 203 at a certain temperature range are taken into consideration, the voltage V__ of the inversion input terminal of the differential amplifier 100 can be expressed by the following equation (8).

$$V__=(Vz+\Delta Vz)+\{R22/(R21+R22)\}\cdot(Vd+\Delta Vd) \tag{8}$$

Therefore, the constant voltage V6 is expressed by the following equation (9).

$$V6=\{(R11+R12)/R12\}\cdot(Vz+\Delta Vz)+\{R22(R11+R12)/R12(R21+R22)\}\cdot(Vd+\Delta Vd) \quad (9)$$

The temperature characteristics ΔV6 of the constant voltage V6 can be calculated from the following equation (10).

$$\Delta V6=\{(R11+R12)/R12\}\cdot\Delta Vz+\{R22(R11+R12)/R12(R21+R22)\}\cdot\Delta(Vd) \quad (10)$$

When the value of the temperature characteristics ΔV6 of the constant voltage V6 becomes the smallest, that is, ΔV6=0, the following equation (11) is obtained from the equation (10).

$$\Delta Vz=-\{R22/(R21+R22)\}\cdot\Delta Vd \quad (11)$$

In this embodiment, the diode 203 having negative temperature characteristics ΔVD with excellent linearity is used as the temperature characteristics correcting element, the Zener diode 104 having positive temperature characteristics ΔVz with relatively excellent linearity is used as the temperature-dependent element, and the current Iz running through the Zener diode 104 is determined such that the relationship between the temperature characteristics ΔVz of the Zener diode 104 and the temperature characteristics ΔVD of the diode 203 satisfies the following expression (12) so as to improve the temperature characteristics of the constant voltage V6.

$$|\Delta Vz|\leqq|\Delta Vd| \quad (12)$$

A detailed description is subsequently given of the correction of temperature characteristics by the diode 203.

Generally speaking, the temperature characteristics ΔVd of the temperature characteristics correcting element are negative and have excellent linearity as shown by mark ○ in FIG. 2. When the temperature characteristics ΔVz of the Zener diode 104 have excellent linearity as shown in FIG. 3 and the ΔVz and ΔVd satisfy the relationship of the above equation (12), the relationship of the above equation (11) can be satisfied and the constant voltage V6 having excellent temperature characteristics can be obtained by dividing the above ΔVd by the fixed resistors 201 and 202 having resistance values R21 and R22, respectively.

That is, when the temperature characteristics ΔVz of the Zener diode 104 and the temperature characteristics ΔVd of the diode 203 are taken into consideration and the voltage at both ends of the fixed resistor 202 of the voltage dividing circuit 210 is represented by Vk, Vk can be expressed by the equation $$Vk=\{R22/(R21+R22)\}\cdot(Vd+\Delta Vd)=\alpha k\cdot(Vd+\Delta Vd).$$

Therefore, the resistance values R21 and R22 of the fixed resistors 201 and 202 are set and the correction coefficient αk is determined to ensure ΔV6=0 by correcting the temperature characteristics ΔVz of the Zener diode 104 with the above Vk. The above equation (9) can be changed as follows using the above correction coefficient αk.

$$V6=\{(R11+R12)/R12\}\cdot\{(Vz+\Delta Vz)+\alpha k\cdot(Vd+\Delta Vd)\} \quad (13)$$

When the optimal correction coefficient which satisfies the equation (Vz+ΔVz)=−(Vd+ΔVd)×α2 is represented by α2 and other correction coefficients which satisfy α1>α2>α3 are represented by α1 and α3, as shown in FIG. 2, Vk=αk·(Vd+ΔVd) (k=1, 2, 3) shows negative temperature characteristics having different inclinations. FIG. 4 shows results obtained by correcting the temperature characteristics ΔVz of the Zener diode 104 with Vk. The temperature characteristics of the constant voltage V6 are excellent in the case of the optimal correction coefficient α2 and correction is insufficient or excessive in the case of the correction coefficient α1 or α3.

Therefore, the temperature characteristics of the constant voltage V6 can be improved by determining the current Iz running through the Zener diode 104 in consideration of the temperature characteristics ΔVz of the Zener diode 104 and the temperature characteristics ΔVd of the diode 203.

Thus, in the constant voltage circuit of this embodiment, the temperature characteristics control means 200 constructed by connecting the voltage dividing circuit 210 formed by connecting the fixed resistor 201 and the fixed resistor 202 in series and the diode 203 in parallel is provided between the resistor 103 and the Zener diode 104 of the bridge circuit, and the output of the dividing point between the fixed resistor 201 and the fixed resistor 202 of the above control means 200 is applied to the non-inversion input terminal of the differential amplifier 100 to correct the temperature change of the Zener diode 104. Therefore, a constant voltage can be output stably at a wide temperature range of a car control circuit or the like. Further, since the Zener diode 104 having a Zener voltage of around 5 V and small temperature characteristics with excellent linearity and the diode 203 having negative temperature characteristics with excellent linearity are used, a high-precision output voltage can be obtained at a wide temperature range.

As having been described above, according to the first aspect of the present invention, temperature characteristics control means having a temperature characteristics correcting element having temperature characteristics opposite to those of the temperature-dependent semiconductor element is provided between the resistor and the temperature-dependent semiconductor element of the bridge circuit, the output of the connection point of the series circuit on one side of the bridge circuit and the output of the control means on the other side are applied to the input terminal of the differential amplifier, and the temperature change of the temperature-dependent semiconductor element is corrected by the temperature characteristics control means. Therefore, the output voltage can be stabilized even at a wide temperature range.

According to the second aspect of the present invention, the above control means comprises the temperature characteristics correcting element and the voltage dividing circuit having a series circuit connected in parallel to the temperature characteristics correcting element, and the output of the dividing point of the voltage dividing circuit is applied to the differential amplifier. Therefore, the temperature change of the above temperature-dependent semiconductor element can be corrected with simple constitution.

According to the third aspect of the present invention, since the above temperature-dependent semiconductor element is a Zener diode having a positive temperature coefficient and the above temperature characteristics correcting element is a diode having negative temperature characteristics with excellent linearity, the temperature change of the Zener diode can be corrected without fail.

According to the fourth aspect of the present invention, since the above Zener diode has a Zener voltage of around 5 V and small temperature characteristics with excellent linearity, the output voltage can be further stabilized.

According to the fifth aspect of the present invention, since the Zener current of the Zener diode is set to ensure that the temperature change of the Zener voltage becomes smaller than the temperature change of the voltage at both ends of the diode, the temperature change of the Zener diode can be corrected by the diode without fail.

According to the sixth aspect of the present invention, since the constant voltage circuit having excellent temperature characteristics at a wide temperature range is used in a car control circuit, the car control circuit which is used under extreme temperature conditions can be operated stably.

According to the seventh aspect of the present invention, since the constant voltage circuit having excellent temperature characteristics at a wide temperature range is used in a control circuit for a heat sensitive flow sensor which requires the high accuracy of temperature characteristics among car control circuits, the control circuit for a heat sensitive flow sensor can be operated stably.

What is claimed is:

1. A constant voltage circuit comprising a bridge circuit having a series circuit formed on one side by connecting resistors in series and a series circuit formed on the other side by connecting in series a resistor, a temperature-dependent semiconductor element and temperature characteristics control means including a temperature characteristics correcting element having temperature characteristics opposite to those of the temperature-dependent semiconductor element and provided between the resistor and the temperature-dependent semiconductor element, and a differential amplifier, wherein the output of the connection point of the series circuit on one side of the bridge circuit and the output of the temperature characteristics control means on the other side are connected to the input terminal of the differential amplifier.

2. The constant voltage circuit of claim 1, wherein the temperature characteristics control means comprises a temperature characteristics correcting element and a voltage dividing circuit having a series circuit connected in parallel to the temperature characteristics correcting element, and the output of the dividing point of the voltage dividing circuit is applied to the differential amplifier.

3. The constant voltage circuit of claim 1, wherein the temperature-dependent semiconductor element is a Zener diode having a positive temperature coefficient and the temperature characteristics correcting element is a diode.

4. The constant voltage circuit of claim 3, wherein the Zener diode has a Zener voltage of around 5 V.

5. The constant voltage circuit of claim 4, wherein the Zener current of the Zener diode is set to ensure that the temperature change of the Zener voltage becomes smaller than the temperature change of the voltage at both ends of the diode.

6. The constant voltage circuit of claim 1 which is used in a car control circuit.

7. The constant voltage circuit of claim 1 which is used in a heat sensitive flow sensor.

* * * * *